United States Patent [19]

Miyamoto

[11] Patent Number: 4,744,287

[45] Date of Patent: May 17, 1988

[54] RODLESS CYLINDER

[75] Inventor: Michikazu Miyamoto, Soka, Japan

[73] Assignee: SMC Corporation, Tokyo, Japan

[21] Appl. No.: 68

[22] Filed: Jan. 2, 1987

[30] Foreign Application Priority Data

Jan. 21, 1986 [JP] Japan ..... 61-6796[U]

[51] Int. Cl.[4] ..... F15B 15/24

[52] U.S. Cl. ..... 92/13.7; 92/5 R; 92/163; 92/165 PR; 91/DIG. 4

[58] Field of Search ..... 91/DIG. 4; 92/53, 88, 92/163, 165 R, 165 PR, 13.7, 5 R

[56] References Cited

U.S. PATENT DOCUMENTS

| | | | |
|---|---|---|---|
| 3,779,401 | 12/1973 | Carroll | 91/DIG. 4 X |
| 4,043,709 | 8/1977 | Grevich | 92/13.5 X |
| 4,176,586 | 12/1979 | Stoll et al. | 92/5 R |
| 4,488,477 | 12/1984 | Miyamoto | 91/DIG. 4 X |

FOREIGN PATENT DOCUMENTS

| | | | |
|---|---|---|---|
| 2065228 | 6/1981 | United Kingdom | 91/DIG. 4 X |

*Primary Examiner*—Alan Cohan
*Assistant Examiner*—John Rivell
*Attorney, Agent, or Firm*—Oblon, Fisher, Spivak, McClelland & Maier

[57] ABSTRACT

In a rodless cylinder comprising a series of driving magnets mounted on a piston fitted in a cylinder tube and a series of driven magnets on a driven member sliding along the cylinder tube, piping to convey a hydraulic fluid is simplified as follows. Both ends of the cylinder tube and guide rods extending parallel thereto are fastened to two end plates. Two ports through which the hydraulic fluid is supplied to and discharged from pressure chambers on both sides of the piston in the cylinder tube are provided in one of the end plates. While one of the ports communicates directly with one pressure chamber through the end plate, the other port communicates with the other pressure chamber through one of the guide rods and the other end plate. The driven member sliding along the cylinder tube carries the series of driven magnets and two annular sliding members on both sides thereof in such a manner as to be movable in the direction perpendicular to the axis of the cylinder. This eliminates the need of assembling the cylinder tube with very high accuracy. Also, the cylinder can exert its driving force to the maximum extent of its ability since any external force working on the driven member is supported by the guide rods.

9 Claims, 2 Drawing Sheets

RODLESS CYLINDER

BACKGROUND OF THE INVENTION

1. Field of the Invention

This invention relates to a cylinder for use in such applications as the driving of machines and conveyance of articles, and more particularly to a cylinder of the type that has no piston rod.

2. Description of the Prior Art

Various hydraulic cylinders dispensing with the piston rod through the use of magnets are known, such as the one disclosed in the U.S. Pat. No. 4,488,477.

A rodless cylinder of such a known type has series of driving and driven magnets axially slidably disposed inside and outside the cylinder tube thereof. The series of driving magnets is attached to a piston that is hydraulically moved inside the cylinder tube along the axis thereof. Said two series of driving and driven magnets are disposed so that unlike poles of the individual magnets are opposite to each other.

Having no rod attached to the piston, rodless cylinders of the type just described conserve much more space in the direction of stroke than common piston cylinders that come with rods. With a cylinder that comes with a piston rod, the length of the piston rod plus the cylinder becomes almost twice that of the stroke thereof when the piston rod projects from the cylinder to the maximum extent. As opposed to this, the overall length of a rodless cylinder is always substantially equal to that of the stroke thereof irrespective of the position of the piston.

When put to actual use, such as in a conveyor, however, provision must be made to prevent the series of driven magnets disposed outside the cylinder tube from revolving therearound. Here arises the need of providing guide rails or other similar rails along the cylinder tube so that the member to be guided thereby and the outer series of driven magnets are integrated. But this integration involves a disadvantage that the size of the driven member increases.

Also, piping to supply the pressurized fluid to drive the piston from both ends of the cylinder tube should be provided together with said rails. But such piping might offer an obstacle to the smooth execution of work.

In integrating the member to be guided by such rails and the series of driven magnets outside the cylinder tube, the driven member may consist of a block perforated with holes to pass the cylinder tube and rods, pipes or other appropriate members serving as the guiding rails. But this arrangement also involves some practical problems as pointed out below.

To begin with, the driven member cannot slide smoothly unless the cylinder tube and guiding rails are always precisely kept in a given positional relationship or in positions corresponding to the holes provided in the block. Keeping the cylinder tube and guiding rails in a given positional relationship not only is technically difficult, but also will prove extremely costly even when achieved. Then, to derive the maximum driving force from the cylinder, any load acting on the block making up the driven member should be supported not by the cylinder tube but by the guiding rails.

SUMMARY OF THE INVENTION

An object of this invention is to provide a rodless cylinder having rails to guide a driven member that is provided parallel to a cylinder tube, with holes to pass the cylinder tube and guiding rails being provided in the driven member to ensure that the driven member is stably moved along the cylinder tube and guiding rails.

Another object of this invention is to provide a rodless cylinder with a driven member that consists of a block through which a cylinder tube and guiding rails are passed adjoiningly, thereby reducing the size of the driven member.

Still another object of this invention is to provide a rodless cylinder with guiding rails parallel to a cylinder tube, in which passages for pressurized fluid are provided in the guiding rails to eliminate the need for separate feeding and discharging piping. Connecting such passages to a centralized piping at one of the end plates permits considerable simplification of the whole piping structure.

Especially in a rodless cylinder having series of axially slidable driving and driven magnets disposed inside and outside a cylinder tube, with the series of driving magnets being axially driven by a pressurized fluid, the outer series of driven magnets need not be fitted closely to the cylinder tube if it is permissible to sacrifice some of the attractive force between the two series of magnets. Another object of this invention is to permit lowering the assembling accuracy of the cylinder tube by fitting a guide rod to guide the driven member outside the cylinder tube taking advantage of the aforementioned feature of magnet-based rodless cylinders.

Yet another object of this invention is to provide a rodless cylinder that eliminates the need of keeping a cylinder tube and guiding rails in a highly accurate positional relationship by providing a series of magnets on a driven member outside the cylinder tube, which corresponds to a series of magnets on a piston fitted in the cylinder tube, in such a manner that the motion thereof relative to the driven member is restrained in the direction of travel but allowed in the direction perpendicular thereto.

A further object of this invention is to provide a rodless cylinder that permits deriving the maximum driving force therefrom by supporting any load working on the driven member thereof not by the cylinder tube but by the members that make up the guiding rails.

Further objects of the invention will become apparent from the following description of a preferred embodiment of this invention. Because the following example is a preferred embodiment of the invention, it should be understood that design can be modified without departing from its spirit and scope specified in the appended claims.

DESCRIPTION OF THE PREFERRED EMBODIMENT

Referring now to the accompanying drawings, a preferred embodiment of this invention will be described in details in the following.

Figure 1:
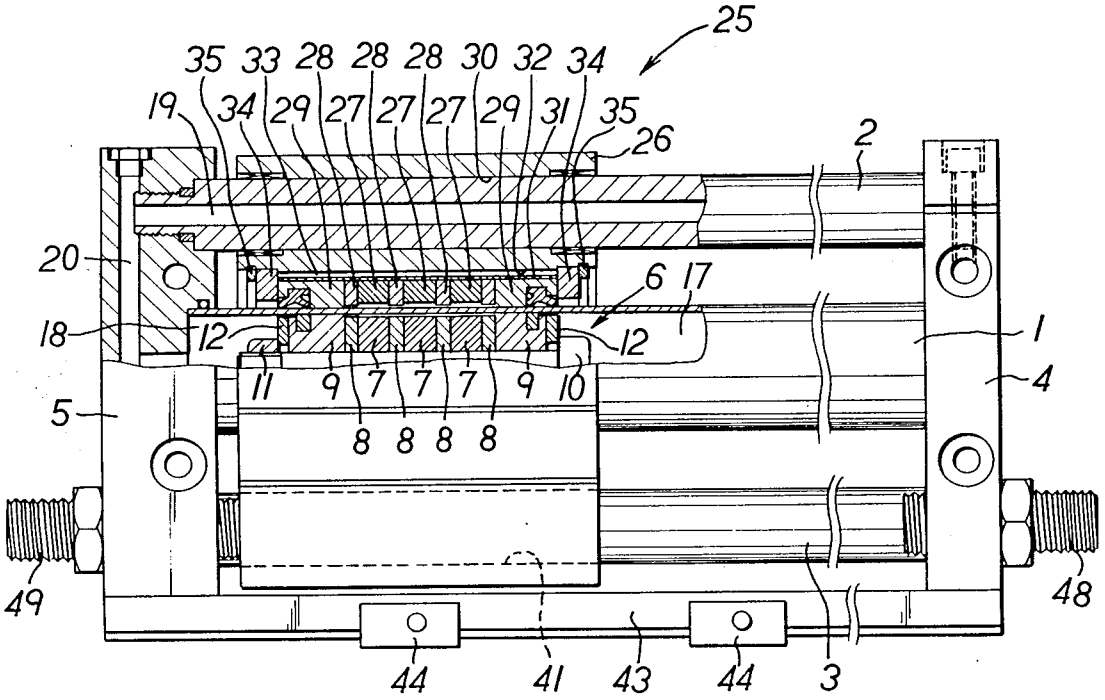
FIG. 1 is a partially cross-sectional plan view of a rodless cylinder according to this invention.
Figure 2:
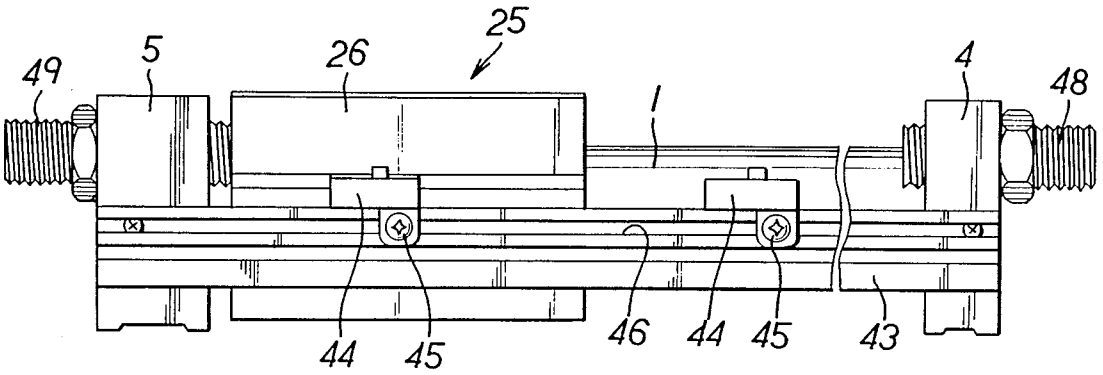
FIG. 2 is a front view of the same rodless cylinder.
Figure 3:
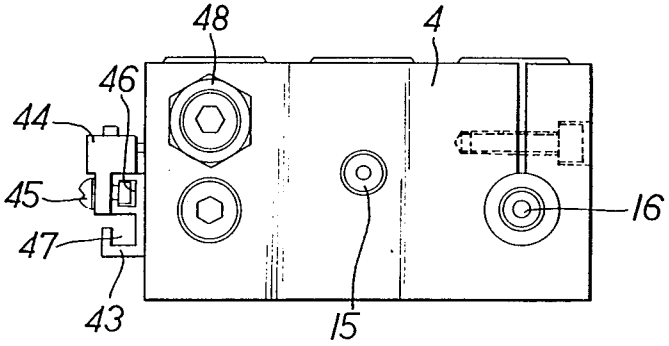
FIG. 3 is a side elevation of the same rodless cylinder.

In a rodless cylinder shown in FIGS. 1 to 3, a cylinder tube 1 and two guide rods 2 and 3, which are disposed parallel thereto, are fastened to end plates 4 and 5 at both ends thereof The end plates 4 and 5 seal both ends of the cylinder tube 1, while firmly fastening the cylinder tube 1 together with the parallel guide rods 2 and 3.

A piston 6 slidably fitted in the cylinder tube 1 carries a series of driving magnets, the series comprising a plurality of annular driving magnets 7 and yokes 8 which are alternately disposed. The series of driving magnets is put between a pair of annular piston members 9 and assembled into one integrated unit together with dampers 12 etc. using a bolt 10 and a nut 11.

Ports 15 and 16 through which a hydraulic fluid is supplied to and discharged from pressure chambers 17 and 18 on both sides of the piston 6 in the cylinder tube 1 are provided in one of the two end plates 4. To be more specific, the port 15 through which a hydraulic fluid is supplied to and discharged from the pressure chamber 17 on that side of the piston 6 in the cylinder tube 1 which is closer to the end plate 4 is provided in that position of the end plate 4 which corresponds to the cylinder tube 1. Meanwhile, the port 16 through which a hydraulic fluid is supplied to and discharged from the pressure chamber 18 on the opposite side of the piston 6 in the cylinder tube 1 is provided in that position of the same end plate 4 which corresponds to the guide rod 2. The port 16 communicates with the pressure chamber 18 through a passage 19 in the guide rod 2 and another passage 20 in the other end plate 5. The other guide rod 3 has no passage provided therein.

A driven member 25 that slides along the cylinder tube 1 comprises a series of driven magnets that are fitted outside the cylinder tube 1 and contained in a block 26. The series of driven magnets comprises a plurality of annular driven magnets 27 and yokes 28 which are alternately disposed. The driven magnets and yokes are put between a pair of annular sliding members 29 and fitted in the block 26, thereby making up the driven member 25. The series of driven magnets and annular sliding members 29 at both ends thereof thus fitted in the block 26 are contained in a holding cylinder 31 of such a nonmagnetic material as stainless steel. The holding cylinder 31 is then inserted in a bore 32 provided in the block 26 and fastened so as to prevent movement along the axis of the cylinder tube 1 with stop rings 35, with a small clearance 33 being left and spacers 34 kept in contact with both ends thereof.

In this condition, it is only the annular sliding members 29 that slide over the peripheral surface of the cylinder tube 1 in contact therewith. The annular sliding members 29 are contained in the holding cylinder 31 together with the series of driven magnets, which are integrally put in the bore 32 in such a manner as to be movable in the direction that is perpendicular to the axis of the cylinder tube 1. Therefore, the series of driven magnets is not allowed to move freely in the block 26 along the axis of the cylinder, while being movable relative to the block in the direction perpendicular thereto.

The block 26 also has through-holes 30 and 41 through which the guide rods 2 and 3 are passed. Both the through-holes 30 and 41 and guide rods 2 and 3 are precision-finished so that the latter slide smoothly through the former.

Accordingly, even when an external force, such as a certain load, acts on the driven member 25 sliding along the cylinder tube 1 and guide rods 2 and 3, such a load is supported by the guide rods 2 and 3. The load does not work on the cylinder tube 1 because the annular sliding members 29 the block 26 is movable relative to in the direction perpendicular to the axis of the cylinder 1, due to the small clearance 33. Therefore, the piston can exert force to the maximum extent of its ability.

In each of said series of driving magnets 7 on the piston 6 and driven magnets 27 on the driven member 25, the individual magnets are disposed so that like poles are positioned next to each other, while unlike poles of the two series are positioned opposite to each other on both sides of the cylinder tube 1.

A rail 43 provided between the two end plates 4 and 5 carries detectors 44 to locate the driven member 25. A groove 46 containing nuts screwing onto a bolt that fastens the detector 44 are provided, next to another groove 47 through which wiring for the detectors 44 run. The latter groove 47 keeps the wiring from getting cluttered up.

The detectors 44 senses the approach of a position detecting magnet mounted on the block 26 of the driven member 25 and sends out a corresponding electric signal.

Adjust bolts 48 and 49 screwed through the end plates 4 and 5 to limit the stroke of the drive member 25 may also serve as shock absorbers.

In the rodless cylinder of the structure just described, as a hydraulic fluid is supplied through a change-over valve, not shown, and the port 15 and the port 16 is opened to the atmosphere, the piston 6 moves toward the end plate 5, whereupon the driven member 25 is moved, side by side with the piston 6, along the cylinder tube 1 by the attractive force acting between the series of magnets on the piston 6 and the other series of magnets on the driven member 25. Since the block 26 of the driven member 25 is guided by the two guide rods 2 and 3, both annular sliding members 29 on the driven member are always kept in steady contact with the peripheral surface of the cylinder tube 1.

Conversely, when a hydraulic fluid is supplied into the pressure chamber 18 from the port 16 through the passages 19 and 20, while opening the port 15 to the atmosphere, the piston 6 and driven member 25 move in the opposite direction.

What is claimed is:

1. A rodless cylinder which comprises:

a cylinder tube whose both ends are fastened to end plates;

at least one guide rod disposed parallel to said cylinder tube, both ends of which being fastened to said end plates;

a piston carrying a series of driving magnets and slidably fitted in said cylinder tube;

a driven member sliding along said cylinder tube and carrying a series of driven magnets sliding along the peripheral surface of said cylinder tube, the series of driving and driven magnets attracting each other and the driven member having through-holes through which said guide rods are slidably passed;

one of said end plates having a pair of ports through which a hydraulic fluid is supplied to and discharged from pressure chambers on both sides of the piston in the cylinder tube, one of the ports communicating directly with one of the pressure chambers and the other port communicating with the other pressure chamber through one of the guide rods and passages provided in the other end plate.

2. A rodless cylinder according to claim 1 including two parallel ones of said at least one guide rod disposed on both sides of said cylinder tube, in which the end plates at both ends of the cylinder tube provide tight sealing thereto and firmly fasten the cylinder tube and the two parallel guide rods disposed on both sides thereof.

3. A rodless cylinder according to claim 2, in which the driven member sliding along the cylinder tube consists of a monolithic block having through-holes through which the cylinder tube and the two guide rods are passed.

4. A rodless cylinder according to claim 1, in which the piston fitted in the cylinder tube consists of a series of driving magnets which is made up of a plurality of alternately disposed annular driving magnets and yokes, the driving magnets and yokes being placed between a pair of piston members and assembled together with a bolt passed through holes in the driving magnets, yokes and piston members and a nut screwed thereon.

5. A rodless cylinder according to claim 4, in which the driven member sliding along the cylinder tube consists of a series of alternately disposed annular driven magnets and yokes fitted over the cylinder tube and placed between a pair of annular sliding members, the series of driving and driven magnets being disposed so that unlike poles thereof are positioned opposite to each other.

6. A rodless cylinder according to claim 1, in which a rail is provided between the end plates so that detectors to locate the position of the driven member are mounted in the desired position.

7. A rodless cylinder according to claim 2, in which adjust bolts to limit the stroke of the driven member are provided on the end plates.

8. A rodless cylinder which comprises:

a cylinder tube whose both ends are fastened to end plates;

guide rods disposed parallel to said cylinder tube, both ends of which being fastened to said end plates;

a piston carrying a series of driving magnets and slidably fitted in said cylinder tube;

a driven member sliding along said cylinder tube;

a series of driven magnets carried by said driven member and sliding along the peripheral surface of said cylinder tube, the series of driven magnets attracting said series of driving magnets and being contained with a pair of annular sliding members disposed at both ends thereof, said driven member being moveable in the direction perpendicular to the axis of the cylinder relative to said annular sliding members and the driven member having through-holes through which said guide rods are slidably passed;

one of said end plates having a pair of ports through which a hydraulic fluid is supplied to and discharged from pressure chambers on both sides of the piston in the cylinder tube, one of the ports communicating directly with one of the pressure chambers and the other port communicating with the other pressure chamber through one of the guide rods and passages provided in the other end plate.

9. A rodless cylinder according to claim 8, in which the series of driven magnets and annular sliding members are contained in a holding cylinder of a nonmagnetic material, the holding cylinder being inserted, with spacers kept in contact with both ends thereof, in a bore provided in the driven member and fastened thnerein with stop rings engaging therewith, a small clearance being provided between said holding cylinder and said bore to thereby allow driven member to move in the direction perpendicular to the axis of the cylinder relative to said annular sliding members.

* * * * *